United States Patent [19]

Chornet et al.

[11] 4,328,089

[45] May 4, 1982

[54] COMBINED DEWATERING AND LIQUID PHASE HYDROGENOLYSIS OF RAW PEAT USING CARBON MONOXIDE

[75] Inventors: Esteban Chornet, Sherbrooke, Canada; Jean-Claude Cavalier, Le Pian, France

[73] Assignee: Universite de Sherbrooke, Quebec, Canada

[21] Appl. No.: 179,566

[22] Filed: Aug. 19, 1980

[30] Foreign Application Priority Data

Sep. 10, 1979 [CA] Canada ..... 335357

[51] Int. Cl.[3] ..... C10G 1/06

[52] U.S. Cl. ..... 208/8 R

[58] Field of Search ..... 208/8 R

[56] References Cited

U.S. PATENT DOCUMENTS

| | | | |
|---|---|---|---|
| 985,462 | 2/1911 | Shepard et al. | |
| 1,563,295 | 11/1925 | Saver . | |
| 2,705,697 | 4/1955 | Royster | 208/8 |
| 3,733,255 | 5/1973 | Appell et al. | 201/25 |
| 3,864,096 | 2/1975 | Urban | 44/50 |
| 4,030,981 | 6/1977 | Hess et al. | 208/8 |
| 4,038,172 | 7/1977 | Ueda et al. | 208/10 |
| 4,045,187 | 8/1977 | Brink et al. | 208/8 |
| 4,089,773 | 5/1978 | Espenscheid | 208/8 |
| 4,263,125 | 4/1981 | Weil et al. | 208/8 R |

OTHER PUBLICATIONS

Cavalier, et al.; "Fractionation of Peat-Derived Bitumen into Oil and Asphaltenes;" *Fuel* 57 (1978) pp. 304–308.

Chornet, et al.; "Conversion of Peat with Carbon Monoxide and Water;" *Fuel* 56 (1977) pp. 57–64.

Appell, et al.; "The Hydrogenation of Coal with Carbon Monoxide and Water"; *Am. Chem. Soc. Div. Fuel Chem.* 12 (1968) pp. 220–224.

Appell, et al; "Solubilisation of Low Rank Coal with Carbon Monoxide and Water"; *Chemistry and Industry*, Nov. 22, 1969, p. 1703.

Appell, et al.; "Dissimilar Behavior of Carbon Monoxide Plus Water and of Hydrogen . . . ", *Am. Chem. Soc. Div. Fuel Chem.* 13 (1969) pp. 39–44.

*Primary Examiner*—Delbert E. Gantz
*Assistant Examiner*—O. Chaudhuri
*Attorney, Agent, or Firm*—Cushman, Darby & Cushman

[57] ABSTRACT

There is provided a process for the hydrogenolysis of raw humid peat by treating untreated peat as obtained from the bog with carbon monoxide at a temperature of from 350° to 373° C. and under a pressure up to 35 MPa and recovering bitumen-like compounds from the non-aqueous phase.

2 Claims, No Drawings

COMBINED DEWATERING AND LIQUID PHASE HYDROGENOLYSIS OF RAW PEAT USING CARBON MONOXIDE

BACKGROUND OF THE INVENTION

The use of peat as an alternate source of energy has been gaining attention in the past years in view of its large reserves in many countries of the world and its easy accessibility when compared to oil and coal. The main interest of peat has centered on its use as a combustion alternate to coal, oil, gas or electricity and its conversions to gaseous and liquid fuels.

The liquefaction of peat by hydrogenolysis with carbon monoxide has been described in FUEL 56, 57 (1977) and FUEL 57, 304 (1978).

Generally speaking in the treatment of peat it has been the practice to recover peat from the bog, submit it to a drying process to reduce its water content, transport the substantially dry peat to the site of treatment, rehumidify the peat or blend the peat with an oil prior to its liquefaction treatment and subject the humid peat or oil-containing peat to hydrogenolysis with and without the presence of a shift catalyst. Unfortunately, this system provides the use of a large amount of energy in order to dry the humid peat from the bog and transportation to the treatment site.

It is also known that peat has a very diversified spectrum of constituents which makes this material quite different from coals and other cellulosic materials in its structure as well as in the oxygen content and its mineral content. It is believed that an important change occurs in peat after reducing its water content by conventional means. It is readily appreciated that the two highly important elements in peat are its percentages of carbon and hydrogen while the third element, to be removed by the hydrogenolysis step, is the oxygen. It has been found that the percentages of these three elements are altered by the drying process of peat as obtained from the bog. For example, after reducing the water content of bog peat to about 20%, it is found that the carbon content decreases from 59–63% to 48–53%, the oxygen content increases from 31–34% to 40–46% with no change in the hydrogen content taking place. Thus substantial oxidation takes place during conventional processing of peat together with a loss of its colloidal properties.

Accordingly, it would be highly desirable to maximize the inherent properties and composition of untreated bog peat for the liquefaction of peat to highly desirable hydrocarbons and/or bitumen-like compounds.

SUMMARY OF THE PRESENT INVENTION

In accordance with the present invention, there is now provided an improved process for the conversion of peat to hydrocarbons and/or bitumen-like compounds by the hydrogenolysis of peat in the presence of carbon monoxide wherein the improvement comprises submitting untreated bog peat to a simultaneous dewatering and hydrogenolysis action in the absence of a shift catalyst at a temperature of from 300° to 373° C. and under pressure, and extracting the hydrocarbons and/or bitumen-like compounds thus produced.

It is surprising that in the improved process of the present invention the fact that untreated bog peat as starting material appears to allow the carbon monoxide to act both as a hydrogen producing agent via shift reactions with the water in the bog peat and as an oxygen acceptor resulting in the formation of carbon dioxide in the absence of an added catalyst such as alkali carbonate. It would appear that there are certain inorganic compounds in bog peat having a relatively high water content which disappear or are transformed when bog peat is dried to a water content of about 20% and rehumidified with water as suggested in the prior art where a catalyst is used. It is unexpected that the inorganic factors present in humid bog peat are sufficient to catalyze the reaction or provide the activity needed for these reactions.

DETAILED DESCRIPTION OF THE PRESENT INVENTION

Raw peat directly from the bog and having a water content of from 80 to 95% is charged in an autoclave in the absence of added water and catalyst. Carbon monoxide with or without hydrogen is then introduced and the autoclave is heated to a temperature within the range of from 350° to 373° C. under a pressure up to 35 MPa. The reaction is then conducted for a period of up to 120 min.

The gas formed during the reaction is vented off. The organic product resulting from the reaction and the aqueous fraction are withdrawn and separated and the remaining material in the autoclave is extracted with benzene or toluene leaving a solid residue. Evaporation of the benzene or toluene fraction provides the oils soluble in benzene or toluene present in the residue. These oils are mixed together with the organic product previously withdrawn and the mixture, herein referred to as the bitumen, is extracted with pentane. The pentane solubles are known as the oils, whereas the pentane insolubles constitute the asphaltenes.

The following examples are given to illustrate the invention rather than to limit its scope.

EXAMPLES 1–9

A medium humidified forest peat, a mixture of sphagnum and carex from the Villeroy bog in Lotbinière county (Quebec, Canada) was used as a raw material for the experiments. The moisture content of this particular peat was 85.1% and its ash content 8.1% relative to the dry matter in peat. The elemental analysis of the dry material (ash plus organic matter) gave C: 55.0%; H: 5.8%; 0:31.7%; N: 2.1% and S: 0.25%.

The experimental work was conducted in a 1 l Inconel 600 rocking Parr autoclave equipped with an automatic temperature controller. The charge of raw peat into the autoclave was 200 g which corresponds 27.4 g of organic (maf) material. Once the system closed, nitrogen was flushed through the lines and the autoclave to displace the air. Then, the reactor was pressurized with CO and subsequentially heated to reaction temperature were the hydrogenolysis reaction was carried out for 2 hr. The agitation was maintained during the reaction period, and was stopped after the 2 hr have elapsed. The autoclave was then left to cool down to room temperature.

During the course of the experiments the gas phase was followed by intermittent sampling and analysis with a Perkin-Elmer® 3920 GC equipped with TC detectors. A system of two columns packed with Porapaq® Q and Molecular Sieve 5A respectively separated the main constituents of the gas.

The product work-up was carried out as follows: once the autoclave at room temperature the gaseous phase was purged out through a series of traps and a wet test meter. Once the system reached atmospheric pressure the autoclave was opened. The distinct aqueous phase was easily separated from the heavy organic material by simple decantation. Undoubtedly some soluble organic components are found in the aqueous phase in small amounts but they were not taken into account in the overall material balances. The product left in the autoclave after the decantation of the aqueous phase and the autoclave walls were washed out with toluene and the whole mixture extracted with additional toluene in a Soxhlet apparatus for about 48 hr. The toluene soluble bitumen was recovered by evaporation of the toluene. Both the bitumen and the dried unextracted solid residue were weighted. The bitumen was further extracted with n-pentane to determine oils and asphaltenes.

The percentage of conversion and yield of bitumen for a reaction time of 2 hours are reported in Table I.

TABLE I

| Experiment No. | Initial CO Pressure (MPa) | Temp °C. | % Conversion (C) | % Bitumen Yield ($Y_b$) |
|---|---|---|---|---|
| 1 | 5.5 | 300 | 71.2 | 24.8 |
| 2 | 8.3 | 300 | 81.2 | 35.4 |
| 3 | 5.5 | 350 | 97.0 | 53.3 |
| 4 | 8.3 | 350 | 96.2 | 56.6 |
| 5 | 5.5 | 300 | 73.5 | 24.8 |
| 6 | 8.3 | 300 | 80.2 | 37.9 |
| 7 | 5.5 | 350 | 97.0 | 58.4 |
| 8 | 8.3 | 350 | 98.0 | 59.8 |
| 9 | 6.9 | 325 | 85.3 | 41.2 |

The influence of temperature seems to be more important than that of the pressure in both conversion and bitumen yields. Within the range of variables considered the optimum bitumen yields will be obtained at the highest temperature (350° C.) and initial cold pressures (8.3 MPa).

The somewhat limited influence of pressure on the bitumen yields suggests that the hydrogenolysis can proceed at milder conditions without significantly affecting the bitumen yields and also conversion.

1. Conversion and bitumen yield

Conversion is defined in the conventional way as:

$$C_{\%} = (27.4 - a)/27.4 \times 100$$

where:

$a = y_s - 2.4$ $y_s$ = toluene insoluble solid residue (g) excluding the amounts present as solid residue in the aqueous phase.

2.4 = ash present in the moisture-free peat.

27.4 = organic material present in the raw peat. This amount is also known as the maf peat charged to the autoclave.

a = the organic material still present in the toluene insoluble solid residue.

The bitumen yield, $Y_b$, is simply defined as the toluene soluble organic material divided by the maf peat (in this case 27.4 g).

2. Bitumen properties

The bitumen was a sticky black solid at room temperature and liquefied when heated, i.e. the bitumen from run No. 8 was fluid at 70° C.

The elemental analysis of the peat, the bitumen and the toluene insoluble solid residue are given in Table II. The increase in the hydrogen content of the bitumen relative to the original peat and the considerable reductions in oxygen and sulfur are quite significant and would facilitate further hydrogenation of the material.

The fractionation of the bitumen into oils and asphaltenes gave approximately the same result for all the experiments: 55% oils and 45% asphaltenes.

TABLE II

Elemental Analysis of Peat, Bitumen and Toluene Insoluble Residue from Exp. No. 8.

| | C % | H % | O % | N % | S % |
|---|---|---|---|---|---|
| Peat | 55.0 | 5.8 | 31.7 | 2.1 | 0.25 |
| Bitumen | 80.1 | 9.3 | 7.1 | 1.8 | 0.10 |
| Residue | 15.6 | 1.1 | 17.2 | 0.3 | 0.70 |

3. Gaseous phase

The major gaseous products were hydrogen and carbon dioxide. The general tendencies were that conversion of carbon monoxide into these products was favoured by increasing temperature.

SEPARATION OF THE DIFFERENT PHASES

In all the experiments a clear separation between the aqueous phase and the mixture formed by the bitumen and the solid residue was observed. Moreover, the results indicate that the colloidal state of raw peat is fully destroyed by the reaction.

In most experiments the aqueous phase, which is recovered immediately after opening of the autoclave, is a turbid liquid. After filtration the liquid is clear and colourless. However, with exposure to ambient UV radiation the liquid gradually changes to a black turbid colour with a black solid precipitate.

The weight of the black precipitate varied between 1.1% and 2.5% of the maf peat initially charged. The weight of the remaining soluble residue was determined by evaporation of the water and was found to range between 1.1% and 4.7% of the maf peat initially charged.

The coexistence of two distinct phases throughout the experiment is a unique feature of the system investigated. Even in the extreme case of a reaction temperature of 350° C., 70% of the water initially present accompanying the peat is still a liquid at all times during the reaction. This presence of water as a liquid vehicle seems to be essential to the conversion process investigated. Addition of more water does not result in improved conditions and the same separation features take place as in Exp. No. 9 carried out under the identical conditions but in the absence of added water.

We claim:

1. Process for the hydrogenolysis of raw humid peat with carbon monoxide which consists essentially of submitting untreated peat as obtained from the bog and having a water content of from 80 to 95% to the action of carbon monoxide at a temperature of from 350° to 373° C. and under a total pressure up to 35 MPa, separating the aqueous phase from the non-aqueous phase and recovering the hydrocarbons and/or bitumen-like compounds from the non-aqueous phase.

2. A process according to claim 1 consisting of submitting untreated peat as obtained from the bog and having a water content of from 80 to 95% to the action of carbon monoxide at a temperature of from 350° to 373° C. and under a total pressure up to 5 MPa, separating the aqueous phase from the non-aqueous phase and recovering the hydrocarbons and/or bitumen-like compounds from the non-aqueous phase.

* * * * *